US010787923B2

(12) United States Patent
Clark et al.

(10) Patent No.: US 10,787,923 B2
(45) Date of Patent: Sep. 29, 2020

(54) AXIALLY PRELOADED SEAL

(71) Applicant: UNITED TECHNOLOGIES CORPORATION, Farmington, CT (US)

(72) Inventors: Thomas E Clark, Sanford, ME (US); William M. Barker, North Andover, MA (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 156 days.

(21) Appl. No.: 16/113,836

(22) Filed: Aug. 27, 2018

(65) Prior Publication Data

US 2020/0063587 A1 Feb. 27, 2020

(51) Int. Cl.
*F01D 11/00* (2006.01)
*F01D 11/08* (2006.01)

(52) U.S. Cl.
CPC ..... *F01D 11/005* (2013.01); *F01D 11/08* (2013.01); *F05D 2220/32* (2013.01); *F05D 2240/11* (2013.01); *F05D 2240/14* (2013.01); *F05D 2240/56* (2013.01)

(58) Field of Classification Search
CPC ..... F01D 11/005; F01D 11/08; F01D 25/246; F05D 2220/32; F05D 2240/11; F05D 2240/14; F05D 2240/56
See application file for complete search history.

(56) References Cited

U.S. PATENT DOCUMENTS

| | | | | |
|---|---|---|---|---|
| 5,480,162 | A * | 1/1996 | Beeman, Jr. | F01D 9/023 277/355 |
| 5,609,469 | A * | 3/1997 | Worley | F01D 11/005 415/173.1 |
| 5,848,874 | A * | 12/1998 | Heumann | F01D 9/042 415/189 |
| 6,170,831 | B1 * | 1/2001 | Bouchard | F01D 11/005 277/355 |
| 8,365,538 | B2 | 2/2013 | Buchal et al. | |
| 8,651,497 | B2 | 2/2014 | Tholen et al. | |
| 9,863,538 | B2 * | 1/2018 | Duguay | F01D 25/246 |
| 9,879,557 | B2 * | 1/2018 | Hall | F01D 11/005 |
| 9,896,955 | B2 * | 2/2018 | Tatman | F01D 11/08 |
| 10,145,308 | B2 * | 12/2018 | Roy Thill | F16J 15/0887 |
| 10,400,896 | B2 * | 9/2019 | Davis | F16J 15/3288 |
| 10,487,678 | B2 * | 11/2019 | Tyler, Jr. | F01D 11/005 |
| 2015/0226132 | A1 | 8/2015 | Roy Thill et al. | |
| 2016/0312637 | A1 | 10/2016 | Duguay | |
| 2017/0335705 | A1 | 11/2017 | Tyler, Jr. et al. | |
| 2019/0024801 | A1 * | 1/2019 | Davis | F01D 11/005 |

FOREIGN PATENT DOCUMENTS

| | | |
|---|---|---|
| EP | 2834498 | 2/2015 |

OTHER PUBLICATIONS

European Patent Office, European Search Report dated Nov. 22, 2019 in Application No. 19193917.2.

* cited by examiner

*Primary Examiner* — Brian P Wolcott
(74) *Attorney, Agent, or Firm* — Snell & Wilmer L.L.P.

(57) ABSTRACT

A seal for a gas turbine engine is disclosed. In various embodiments, the seal includes a first annular ring; a second annular ring; an annular brush having a first brush end disposed between the first annular ring and the second annular ring; and an axial ring seal having a first seal end configured for contact with the second annular ring.

15 Claims, 4 Drawing Sheets

AXIALLY PRELOADED SEAL

FIELD

The present disclosure relates to gas turbine engines and, more particularly, to seals used to prevent leakage between gas paths within gas turbine engines.

BACKGROUND

Gas turbine engines, such as those used to power modern commercial and military aircraft, include a fan section to propel the aircraft, a compressor section to pressurize a supply of air from the fan section, a combustor section to burn a hydrocarbon fuel in the presence of the pressurized air, and a turbine section to extract energy from the resultant combustion gases in order to power the compressor and fan sections.

Various gas-flow streams or gas paths exist within gas turbine engines, including a core engine gas path and a bypass duct gas path. Typically, the various gas paths are kept separate from one another using various components, such as seals. Air flows within higher pressure gas paths, such as within high pressure compressor and turbine sections may, however, still tend to leak into air flows within lower pressure gas paths. Such leakages may be exacerbated by temperature extremes and other harsh environmental conditions existing within the internal engine environment and may affect the integrity of the components separating different gas-flow streams. Flow leakage from relatively high pressure gas paths into relatively low pressure gas paths may have a negative effect on engine fuel burn, performance, efficiency and component life.

SUMMARY

A seal for a gas turbine engine is disclosed. In various embodiments, the seal includes a first annular ring; a second annular ring; an annular brush having a first brush end disposed between the first annular ring and the second annular ring; and an axial ring seal having a first seal end configured for contact with the second annular ring.

In various embodiments, the annular brush has a second brush end configured for contact with a radially outer surface of a blade outer air seal. In various embodiments, the axial ring seal has a second seal end configured for contact with an axial face of a component disposed downstream of the annular brush. In various embodiments, the component is a hook connected to the blade outer air seal. In various embodiments, the component is an annular tab extending radially inward from an engine casing structure. In various embodiments, the second seal end of the axial ring seal is disposed radially inward of the first seal end. In various embodiments, the second seal end of the axial ring seal is disposed radially outward of the first seal end.

In various embodiments, the second annular ring includes a socket configured to receive the first seal end of the axial ring seal. In various embodiments, the socket is oriented in a radially inward direction and the second seal end of the axial ring seal is configured for positioning radially inward of the first seal end. In various embodiments, the socket is oriented in a radially outward direction and the second seal end of the axial ring seal is configured for positioning radially outward of the first seal end.

A gas turbine engine is disclosed. In various embodiments, the gas turbine engine includes a blade outer air seal disposed radially outward of a turbine rotor; an engine casing structure disposed radially outward of the blade outer air seal; and an annular seal configured to restrict intermixing of a core flow path and a cooling flow path. In various embodiments, the annular seal includes a first annular ring; a second annular ring; an annular brush having a first brush end disposed between the first annular ring and the second annular ring; and an axial ring seal having a first seal end configured for contact with the second annular ring.

In various embodiments, the annular brush has a second brush end configured for contact with a radially outer surface of the blade outer air seal and the axial ring seal has a second seal end configured for contact with a component disposed downstream of the annular brush. In various embodiments, the second seal end is configured for contact with an axial face of a hook connected to the blade outer air seal. In various embodiments, the second seal end is configured for contact with an annular tab extending radially inward from the engine casing structure. In various embodiments, the second seal end of the axial ring seal is disposed radially inward of the first seal end. In various embodiments, the second seal end of the axial ring seal is disposed radially outward of the first seal end.

In various embodiments, the second annular ring includes a socket configured to receive the first seal end of the axial ring seal. In various embodiments, the socket is oriented in a radially inward direction and the second seal end of the axial ring seal is configured for positioning radially inward of the first seal end. In various embodiments, the socket is oriented in a radially outward direction and the second seal end of the axial ring seal is configured for positioning radially outward of the first seal end.

A turbine section for a gas turbine engine is disclosed. In various embodiments, the turbine section includes a rotor having a plurality of blades; a blade outer air seal disposed radially outward of the rotor; an engine casing structure disposed radially outward of the blade outer air seal; and an annular seal. In various embodiments, the annular ring seal includes a first annular ring; a second annular ring; an annular brush having a first brush end configured for disposition between the first annular ring and the second annular ring and a second brush end configured for contact with the blade outer air seal; and an axial ring seal having a first seal end configured for contact with the second annular ring.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1A:
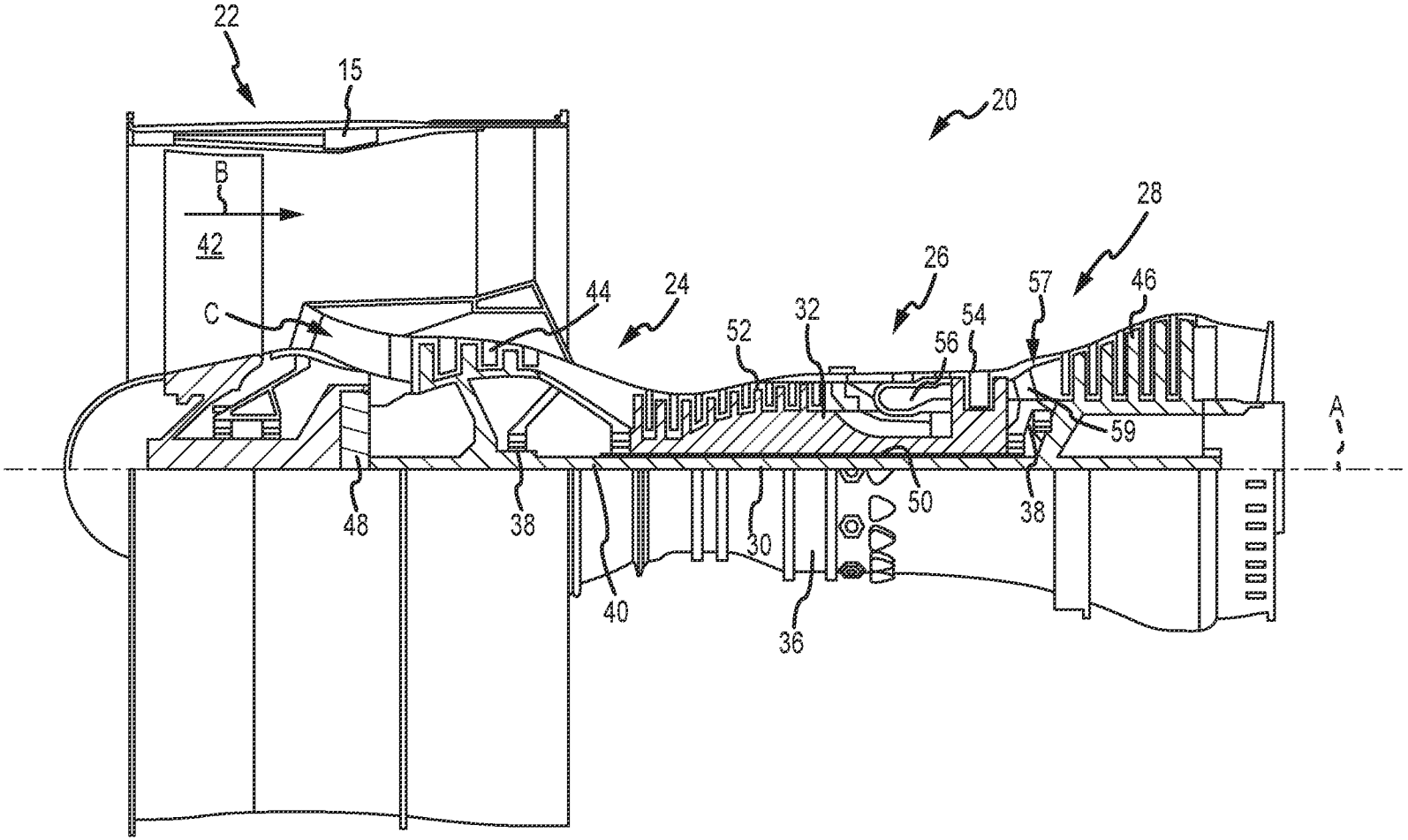
FIG. 1A is a schematic view of a gas turbine engine, in accordance with various embodiments.

Referring now to the drawings, FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, while the compressor section 24 drives air along a core or primary flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems at various locations may alternatively or additionally be provided and the location of the several bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a fan drive gear system 48 configured to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46 and may include airfoils 59 in the core flow path C for guiding the flow into the low pressure turbine 46. The mid-turbine frame 57 further supports the several bearing systems 38 in the turbine section 28. The inner shaft 40 and the outer shaft 50 are concentric and rotate via the several bearing systems 38 about the engine central longitudinal axis A, which is collinear with longitudinal axes of the inner shaft 40 and the outer shaft 50.

The air in the core flow path C is compressed by the low pressure compressor 44 and then the high pressure compressor 52, mixed and burned with fuel in the combustor 56, and then expanded over the high pressure turbine 54 and low pressure turbine 46. The low pressure turbine 46 and the high pressure turbine 54 rotationally drive the respective low speed spool 30 and the high speed spool 32 in response to the expansion. It will be appreciated that each of the positions of the fan section 22, the compressor section 24, the combustor section 26, the turbine section 28, and the fan drive gear system 48 may be varied. For example, the fan drive gear system 48 may be located aft of the combustor section 26 or even aft of the turbine section 28, and the fan section 22 may be positioned forward or aft of the location of the fan drive gear system 48.

Figure 1B:
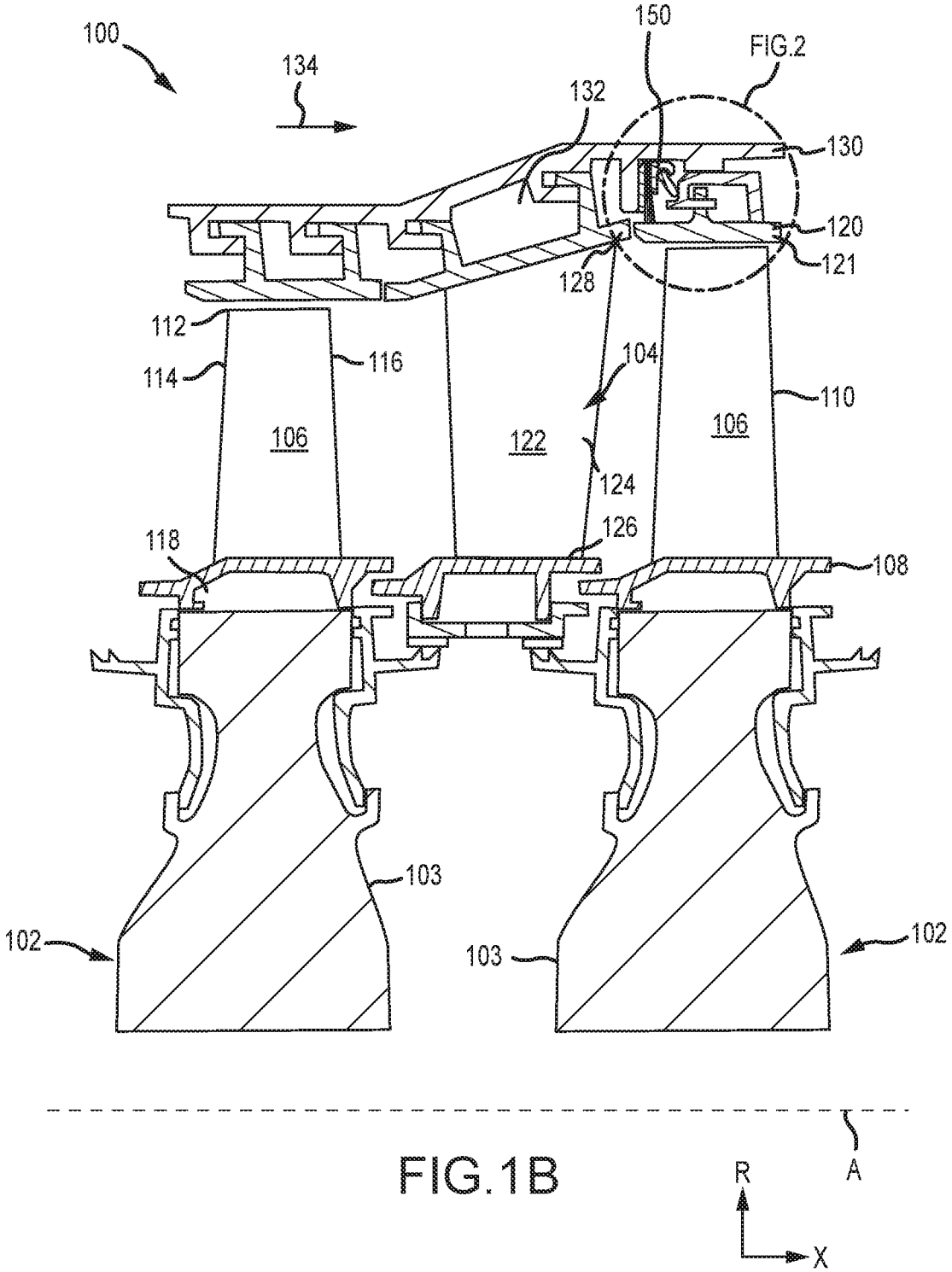
FIG. 1B is a schematic side view of a rotor and vane assembly of a gas turbine engine, in accordance with various embodiments.

Referring now to FIG. 1B, selected portions of a turbine section 100 of a gas turbine engine, such as, for example, the turbine section 28 described above with reference to FIG. 1A, are illustrated. The turbine section 100 includes alternating rows of rotor assemblies 102 and stator assemblies 104. Each of the rotor assemblies 102 carries one or more rotor blades 106 for rotation about a central axis A. Each of the rotor blades 106 includes a rotor platform 108 and an airfoil 110 extending in a radial direction R from the rotor platform 108 to a rotor tip 112. The airfoil 110 generally extends in a chord-wise direction X between a leading edge 114 and a trailing edge 116. A root section 118 of each of the rotor blades 106 is mounted to a rotor disk 103. A blade outer air seal (BOAS) 120 is disposed radially outward of the rotor tip 112 of the airfoil 110. The BOAS 120 includes a platform 121 configured to provide a seal to prevent hot gases from leaking outside the core airflow path C (see FIG. 1).

Each of the stator assemblies 104 includes one or more vanes 122 positioned along the engine axis A and adjacent to one or more rotor blades 106. Each of the vanes 122 includes an airfoil 124 extending between an inner vane platform 126 and an outer vane platform 128. The stator assemblies 104 are connected to an engine casing structure 130. The BOAS 120 and the stator assemblies 104 may be disposed radially inward of the engine casing structure 130. In various embodiments, one or both of the BOAS 120 and the stator assemblies 104 may include full annular platforms or they may be segmented and include feather seals between segments to help prevent leakage of cooling fluid between the segments. In various embodiments, one or more of the vanes 122 may be configured to rotate about an axis extending between the inner vane platform 126 and the outer vane platform 128. In various embodiments, and as described below, an annular seal 150 may be disposed between the BOAS 120 and the engine casing structure 130 to provide further assurance against leakage between separate gas paths.

Figure 2:
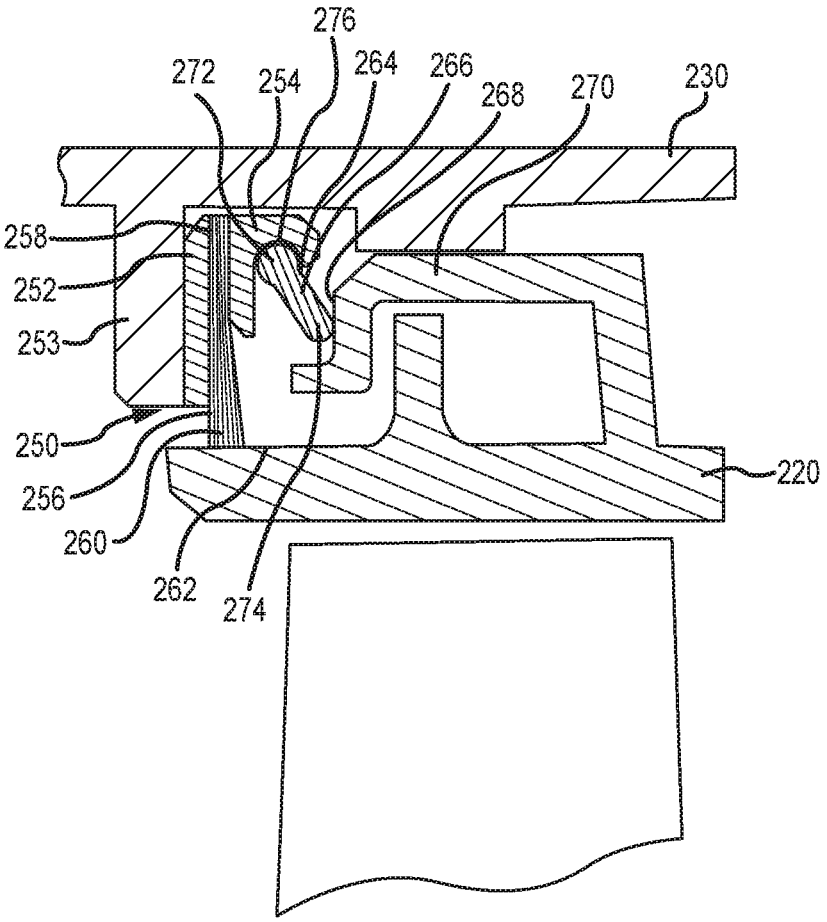
FIG. 2 is a schematic view of a seal used within a gas turbine engine, in accordance with various embodiments.

Referring to FIG. 2, an annular seal 250 is illustrated, in accordance with various embodiments. The annular seal 250 is similar to the annular seal 150 described above with reference to FIG. 1B. In various embodiments, the annular seal 250 is disposed between a BOAS 220 and an engine casing structure 230. In various embodiments, the annular seal 250 includes a first annular ring 252 and a second annular ring 254. The annular seal 250 further includes an annular brush 256, having a first brush end 258 sandwiched between the first annular ring 252 and the second annular ring 254 and a second brush end 260 configured for sealing contact with a radially outer surface 262 of the BOAS 220. In various embodiments, the first annular ring 252 is positioned adjacent an annular tab 253 that extends radially inward from the engine casing structure 230. In various embodiments, the first annular ring 252 and the second annular ring 254 are connected to one another, thereby sandwiching the annular brush 256 there between, by rivets or welding or the like.

In various embodiments, the annular seal 250 further includes an annular ring seal 264 (sometimes referred to in the art as a dog-bone seal 266). In various embodiments, the annular ring seal 264 provides an axial seal that restricts intermixing of gas flow paths and operates as a mechanical spring, due to an elastic pre-load in the axial direction applied to the annular ring seal 264 during assembly of the engine. In various embodiments, the annular ring seal 264 provides an axial interference fit between, for example, a the second annular ring 254 and an axial face 268 of a BOAS hook 270 connected to the BOAS 220. In various embodiments, the axial spring nature of the annular ring seal 264 enables an axial seal to be maintained in the presence of thermal expansion of the various engine components. For example, during instances where the axial face 268 of the BOAS hook 270 and the annular tab 253 of the engine casing structure 230 move axially apart from one another due to thermal expansion, a first seal end 272 of the annular ring seal 264 and a second seal end 274 of the annular ring seal 264 may be subject to a rolling type motion, where the first seal end 272 may be urged in an axially forward direction (i.e., toward the annular tab 253) and the second seal end 274 may be urged in an axially rearward direction (i.e., toward the axial face 268 of the BOAS hook 270). In various embodiments, a socket 276 is disposed within the second annular ring 254 and serves to maintain the first seal end 272 at a constant radial position during thermal expansion of the engine, while the second seal end 274 is free to move in both the axial and radial directions is response to such thermal expansion. In various embodiments, the socket 276 faces radially inward and the first seal end 272 is disposed radially outward of the second seal end 274, enabling the second seal end 274 to move radially outward and axially rearward during thermal expansion of the engine.

Figure 3:
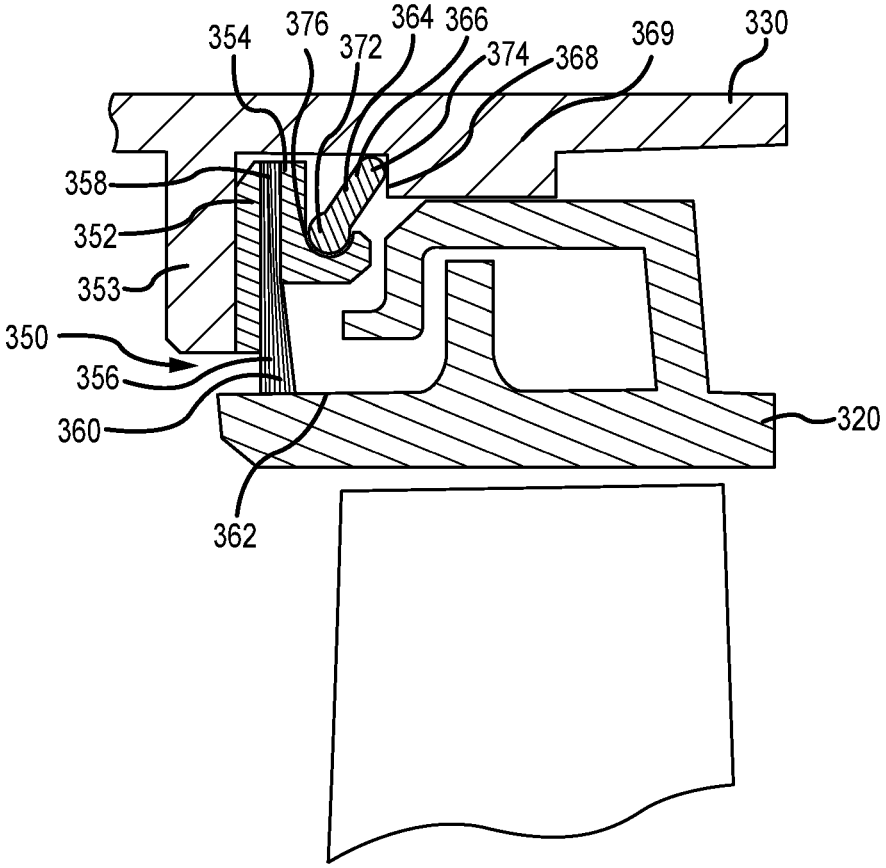
FIG. 3 is a schematic view of a seal used within a gas turbine engine, in accordance with various embodiments.

Referring now to FIG. 3, an annular seal 350 is illustrated, in accordance with various embodiments. In various embodiments, the annular seal 350 is disposed between a BOAS 320 and an engine casing structure 330. In various embodiments, the annular seal 350 includes a first annular ring 352 and a second annular ring 354. The annular seal 350 further includes an annular brush 356, having a first brush end 358 sandwiched between the first annular ring 352 and the second annular ring 354 and a second brush end 360 configured for sealing contact with a radially outer surface 362 of the BOAS 320. In various embodiments, the first annular ring 352 is positioned adjacent an annular tab 353 that extends radially inward from the engine casing structure 330. In various embodiments, the first annular ring 352 and the second annular ring 354 are connected to one another, thereby sandwiching the annular brush 256 there between, by rivets or welding or the like.

In various embodiments, the annular seal 350 further includes an annular ring seal 364 which, in various embodiments, comprises a dog-bone seal 366. In various embodiments, the annular ring seal 364 provides an axial seal that restricts intermixing of gas flow paths and operates as a mechanical spring, due to an elastic pre-load in the axial direction applied to the annular ring seal 364 during assembly of the engine. In various embodiments, the annular ring seal 364 provides an axial interference fit between, for example, a the second annular ring 354 and an axial face 368 of a second annular tab 369 that extends radially inward from the engine casing structure 330. In various embodiments, the axial spring nature of the annular ring seal 364 enables an axial seal to be maintained in the presence of thermal expansion of the various engine components. For example, during instances where the axial face 368 of the second annular tab 369 and the annular tab 353 of the engine casing structure 330 move axially apart from one another due to thermal expansion, a first seal end 372 of the annular ring seal 364 and a second seal end 374 of the annular ring seal 364 may be subject to a rolling type motion, where the first seal end 372 may be urged in an axially forward direction (i.e., toward the annular tab 353) and the second seal end 374 may be urged in an axially rearward direction (i.e., toward the axial face 368 of the second annular tab 369). In various embodiments, a socket 376 is disposed within the second annular ring 354 and serves to maintain the first seal end 372 at a constant radial position during thermal expansion of the engine, while the second seal end 374 is free to move in both the axial and radial directions is response to such thermal expansion. In various embodiments, the socket 376 faces radially outward and the first seal end 372 is disposed radially inward of the second seal end 374, enabling the second seal end 374 to move radially inward and axially rearward during thermal expansion of the engine.

In various embodiments, both the annular seal 250 described with reference to FIG. 2 and the annular seal 350 described with reference to FIG. 3 provide a multiple point sealing configuration. For example, the annular brush 256 described with reference to FIG. 2 provides a seal between a core gas path (e.g., air flowing through the turbine section defined by the rotor blades 106 and the vanes 122 and the various platforms described above with reference to FIG. 1B) and a cooling air gas path that may flow between the engine casing structure 230 and the BOAS 220. In addition, the annular ring seal 264 provides a seal by the first seal end 272 and the second seal end 274 being maintained in contact with the corresponding faces of the annular tab 253 and the axial face 268, thereby preventing the cooling air gas path from leaking past the annular ring seal 264. Similarly, the annular brush 356 described with reference to FIG. 3 provides a seal between a core gas path (e.g., air flowing through the turbine section defined by the rotor blades 106 and the vanes 122 and the various platforms described above with reference to FIG. 1B) and a cooling air gas path that may flow between the engine casing structure 330 and the BOAS 320. In addition, the annular ring seal 364 provides a seal by the first seal end 372 and the second seal end 374 being maintained in contact with the corresponding faces of the annular tab 353 and the second annular tab 369, thereby preventing the cooling air gas path from leaking past the annular ring seal 364.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed:

1. A seal for a gas turbine engine, comprising:
a first annular ring;
a second annular ring;
an annular brush having a first brush end disposed between the first annular ring and the second annular ring; and
an axial ring seal having a first seal end configured for contact with the second annular ring,
wherein the annular brush has a second brush end configured for contact with a radially outer surface of a blade outer air seal,
wherein the axial ring seal has a second seal end configured for contact with an axial face of a component disposed downstream of the annular brush and
wherein the second annular ring includes a socket configured to receive the first seal end of the axial ring seal.

2. The seal of claim 1, wherein the component is a hook connected to the blade outer air seal.

3. The seal of claim 1, wherein the component is an annular tab extending radially inward from an engine casing structure.

4. The seal of claim 1, wherein the second seal end of the axial ring seal is disposed radially inward of the first seal end.

5. The seal of claim 1, wherein the second seal end of the axial ring seal is disposed radially outward of the first seal end.

6. The seal of claim 1, wherein the socket is oriented in a radially inward direction and wherein the second seal end of the axial ring seal is configured for positioning radially inward of the first seal end.

7. The seal of claim 1, wherein the socket is oriented in a radially outward direction and wherein the second seal end of the axial ring seal is configured for positioning radially outward of the first seal end.

8. A gas turbine engine, comprising:
a blade outer air seal disposed radially outward of a turbine rotor;
an engine casing structure disposed radially outward of the blade outer air seal; and
an annular seal configured to restrict intermixing of a core flow path and a cooling flow path, the annular seal comprising:
a first annular ring;
a second annular ring;
an annular brush having a first brush end disposed between the first annular ring and the second annular ring; and
an axial ring seal having a first seal end configured for contact with the second annular ring,
wherein the annular brush has a second brush end configured for contact with a radially outer surface of the blade outer air seal,
wherein the axial ring seal has a second seal end configured for contact with a component disposed downstream of the annular brush and
wherein the second annular ring includes a socket configured to receive the first seal end of the axial ring seal.

9. The gas turbine engine of claim 8, wherein the second seal end is configured for contact with an axial face of a hook connected to the blade outer air seal.

10. The gas turbine engine of claim 8, wherein the second seal end is configured for contact with an annular tab extending radially inward from the engine casing structure.

11. The gas turbine engine of claim 8, wherein the second seal end of the axial ring seal is disposed radially inward of the first seal end.

12. The gas turbine engine of claim 8, wherein the second seal end of the axial ring seal is disposed radially outward of the first seal end.

13. The gas turbine engine of claim 8, wherein the socket is oriented in a radially inward direction and wherein the second seal end of the axial ring seal is configured for positioning radially inward of the first seal end.

14. The gas turbine engine of claim 8, wherein the socket is oriented in a radially outward direction and wherein the second seal end of the axial ring seal is configured for positioning radially outward of the first seal end.

15. A turbine section for a gas turbine engine, comprising:

a rotor having a plurality of blades;

a blade outer air seal disposed radially outward of the rotor;

an engine casing structure disposed radially outward of the blade outer air seal; and an annular seal comprising:

a first annular ring;

a second annular ring;

an annular brush having a first brush end configured for disposition between the first annular ring and the second annular ring; and an axial ring seal having a first seal end configured for contact with the second annular ring, wherein the annular brush has a second brush end configured for contact with a radially outer surface of the blade outer air seal, wherein the axial ring seal has a second seal end configured for contact with a component disposed downstream of the annular brush and wherein the second annular ring includes a socket configured to receive the first seal end of the axial ring seal.

* * * * *